US008517410B2

(12) United States Patent
Pedersen et al.

(10) Patent No.: US 8,517,410 B2
(45) Date of Patent: Aug. 27, 2013

(54) STEERABLE AND/OR CONVERTIBLE SPORT BOARDS

(75) Inventors: Bradley D. Pedersen, Mississauga (CA); Kyle Jeffs, Mississauga (CA)

(73) Assignee: Tech 4 Kids, Inc., Ontario (CA)

( * ) Notice: Subject to any disclaimer, the term of this patent is extended or adjusted under 35 U.S.C. 154(b) by 101 days.

(21) Appl. No.: 13/253,009

(22) Filed: Oct. 4, 2011

(65) Prior Publication Data

US 2012/0080867 A1 Apr. 5, 2012

Related U.S. Application Data

(60) Provisional application No. 61/389,676, filed on Oct. 4, 2010.

(51) Int. Cl.
*A63C 5/04* (2006.01)

(52) U.S. Cl.
USPC ..... 280/609; 280/601; 280/606; 280/608; 280/610

(58) Field of Classification Search
USPC ..... 280/601, 606, 608
See application file for complete search history.

(56) References Cited

U.S. PATENT DOCUMENTS

| | | | | |
|---|---|---|---|---|
| 4,221,394 | A * | 9/1980 | Campbell | 280/14.25 |
| 6,318,749 | B1 * | 11/2001 | Eglitis et al. | 280/607 |
| 7,422,228 | B2 * | 9/2008 | Cheung | 280/609 |
| 2004/0262884 | A1 * | 12/2004 | Langford et al. | 280/601 |
| 2007/0278753 | A1 * | 12/2007 | Candler | 280/14.22 |

* cited by examiner

*Primary Examiner* — John R Olszewski
*Assistant Examiner* — Hilary L Johns
(74) *Attorney, Agent, or Firm* — Adam K. Sacharoff

(57) ABSTRACT

A sport board is provided having a running surface which provides improved steering and directional control of the sport board. In one embodiment, the sport board has an arcuate bottom with a series of alternating ridges and grooves. The central ridges and grooves run parallel to the longitudinal axis of the board, while the ridges and grooves in the side areas run perpendicular to the longitudinal axis of the board. In a second embodiment, the sport board comprises a bottom having a small number of a larger ridges and grooves which arrangement provides better control. By use of either approach, however, turning and cornering of the board is more controllable. The board is also fitted with foot straps so as to be easily convertible from a sport board configuration to a snowboard configuration.

14 Claims, 6 Drawing Sheets

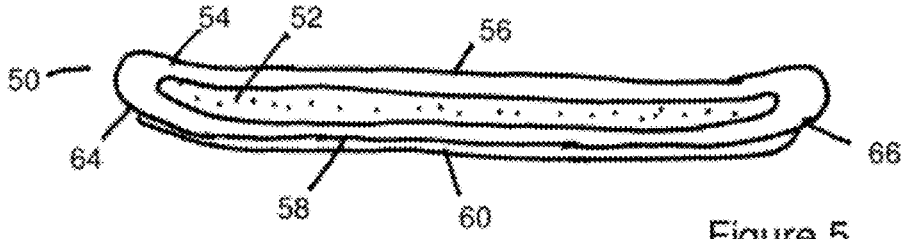
Figure 5
Figure 6A
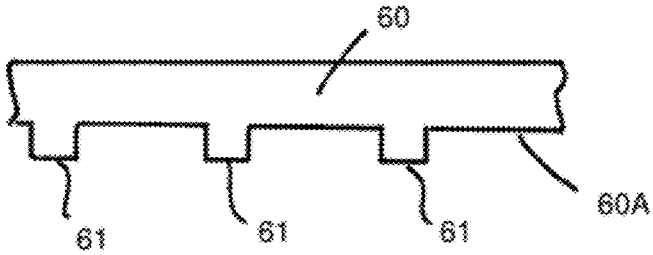
Figure 6B
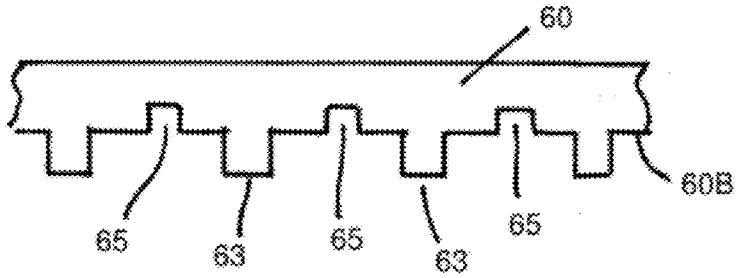

STEERABLE AND/OR CONVERTIBLE SPORT BOARDS

RELATED APPLICATIONS

This application claims the benefits of priority under 35 U.S.C. §119(e) to U.S. Provisional Application Ser. No. 61/389,676, filed Oct. 4, 2010, the entirety of which is hereby incorporated by reference.

FIELD OF THE INVENTION

This invention relates generally to sport boards for recreational use, and, more particularly, to a sport board which has been modified to include a steerable running surface characteristics, and/or modified so as to be convertible to a snow board style of device.

BACKGROUND OF THE INVENTION

Sport boards, and more specifically foam sport boards, are well known in the art, and are used recreationally for gliding along a surface of snow. In this document, the term "sport board" is intended to refer to a style of board for sliding downhill on a snow-covered area. Traditionally, these boards were known as toboggans, or the like, on which a rider will sit, and which slides directly on surface of the snow, without the use of any runners or skis. While toboggans were at one time made of gathered wooden slats, and later metal (such as aluminum), modern sport boards are typically made from plastic materials which typically have a have a foam core encased within a harder plastic outer shell, to which outer shell, graphic materials and the like, can be affixed.

Sport boards can also be provided with handles near the sides of the top surface, so that the seated rider can hang on to the board while gliding on the snow's surface. Traditionally though, steering of a sport board is difficult, and the user merely rides along with the sport board.

This is also in contrast to snowboards, which are typically wooden or hard, rigid plastic, and which are relatively narrow boards on which a user stands while riding the snowboard. Snowboards are too small to sit on, and are generally "steered" by digging one edge of the snowboard or the other into the snow, and thus causing the snowboard to change direction.

Narrower skis, to be fitted individually to a user's feet are also well known.

In U.S. Pat. No. 5,328,200, a ski or snowboard is disclosed which has a scored plastic sole in which the scores are generally sinusoidal and have a width of 0.05 to 0.4 mm and a depth of 0.01 to 0.05 mm. The board is made from plastic and the longitudinal distance between the scores is not addressed other than to indicate that several tens of them may lie side by side over the width of the board. The scores are made either by grinding or milling.

U.S. Pat. No. 6,290,249 discloses a snow gliding apparatus with a number of channels cut into the bottom of the board. The channels do not appear to be closely spaced. The channels are cut into the bottom surface of the apparatus with a router or some other cutting device.

U.S. Pat. No. 7,422,228 describes a sport board in which the running surface of the board is provided by a substantially flexible and planar layer which has been laminated to the bottom of the board, and which planar layer includes a series of parallel and alternating grooves and ridges. About 10 to 80 grooves per inch are described, and the grooves are from 0.05 to 1 mm in depth. The grooves and ridges are aligned with a longitudinal axis of the sport board so as to promote travel in the direction that the board is aimed, and minimize any tendency for the board to rotate or veer offline.

While these devices provide some benefits to the toboggan or sport board art, it would still be advantageous to provide a foam core sport board with spaced grooves and ridges, which can be cost effectively manufactured and which would provide improved performance when in use. In particular, it would be beneficial to provide such a sport board which provides an enhanced ability to corner, and/or turn, in any direction desired by the operator.

Alternatively, it would be advantageous to provide a foam core sport board which can act, in part, as a snowboard, and thus allow the user to use the sport board in a manner similar to that of a snowboard.

Accordingly, one general objective of the present invention is to provide an improved sport board having a specific bottom surface that incorporates grooves and ridges, in a particular pattern, that provides improved gliding and turning properties.

In a further objective, the present invention also provides a sport board which can be easily converted to a snow board, and thus provide the user with the option of using the convertible board as either a sport board, or a snow board.

SUMMARY OF THE INVENTION

An exemplary implementation of a first aspect of the sport board of the present invention is that of a sport board preferably having a foam core, and a harder polymer outer shell, wherein a running surface is preferably laminated to the bottom of the board, wherein said laminated running surface comprises a series of longitudinally extending, parallel and alternating grooves and ridges provided across the running surface. As such, in a first aspect, the present invention provides a convertible sport board having a polymer shell, wherein a running surface is preferably laminated to the bottom of the board, wherein said laminated running surface comprises a series of longitudinally extending grooves on the running surface to provide improved gliding and turning properties which allow the sport board to be used as a snowboard.

In one embodiment, the sport board additionally has a generally arcuate cross-section profile across the bottom of the board, which is perpendicular to the longitudinal axis, so that in normal use when gliding on the snow's surface, only a central portion of the sport board is in contact with the snow's surface. The grooves and ridges in this central portion are therefore aligned with the longitudinal axis of the sport board so as to promote travel in the direction that the board is aimed, and minimize any tendency for the board to rotate or veer offline.

Due to the arcuate profile however, side portions on each side of the sport board are not normally in contact with the snow's surface. On these side portions however, a series of substantially parallel and alternating set of grooves and ridges is also provided. However, on these side portions, the alternating set of grooves and ridges are primarily not parallel to the longitudinal axis of the sport board. The grooves and ridges on these side portions have sections which are preferably at least 10 degrees off of being parallel to the longitudinal axis, and more preferably, the side portions have sections wherein at least a portion of the grooves and ridges present, are between 10 and 90 degrees off parallel to the longitudinal axis.

In one preferred embodiment, the grooves and ridges are located in a preferably arcuate, side area at the side of the sport board, and are between 70 and 90 degrees off parallel to the longitudinal axis, and more preferably, are essentially perpendicular (90 degrees) to the longitudinal axis of the sport board. Still further, in a most preferred embodiment, an intermediate area is also provided between the central portion and the arcuate area, in which the grooves and ridges are between 30 and 60 degrees off of parallel, more preferably, between 40 and 50 degrees off parallel, and most preferably, at about 45 degrees off parallel to the longitudinal axis of the sport board.

In operation of the sport board of the present invention, the operator rides the board in a given direction forward, and the board glides across the surface of the snow using primarily the central portion in which the grooves and ridges are aligned with the direction of travel, and are preferably parallel to the longitudinal axis of the sport board. To curve, the user leans to one side or the other, in order to press down on either one side of the board or the other, so that the grooves and ridges in the intermediate area, and/or the side area of the selected side, engage the snow's surface. It will be apparent that because these grooves and ridges are not parallel to the direction that the board is traveling, they act to cause the board to turn in one direction or the other depending on which side of the board is being pressed downward.

In this manner, the operator can control the direction in which the board turns, and thereby, can control the side to side movement of the board. However, because of the arcuate profile, the user has greater control of when the grooves and/or ridges on the side portions contact the ground. As such, by leaning further on one side, and/or by pressing harder on the one side, the user can control the turning force, and thus, can better control the degree to which the sport board will turn.

In a second embodiment of the present invention, the sport board of the present invention includes a reduced number of grooves and ridges, and these grooves and ridges are preferably larger than prior art devices. In particular, in a preferred embodiment, the sport board of the present invention comprises a board having between 0.5 and 9 grooves per inch, and more preferably between 3 and 7 grooves per inch. The grooves and ridges are preferably all aligned in one direction, and preferably are aligned so as to be essentially parallel to the longitudinal axis of the sport board.

Preferably, the grooves and/or ridges are established by providing a series of parallel ridges spaced apart, and wherein the ridges are from 1 mm to 10 mm in height, and more preferably, from 2 mm to 5 mm in height.

Additionally, or alternatively, grooves can also be added between the ridges, so as to provide both ridges and grooves. The grooves can be cut into the laminate layer, using any conventional technique. The grooves preferably have a depth of between 0.1 to 2 mm, and more preferably, between 0.5 and 1 mm.

In this embodiment, the number of ridges and grooves allows a seated user to maintain some control over the directionality of the sport board. However, the reduced number of larger ridges and grooves allows a user to stand on the sport board, in a manner similar to a snowboard. The grooves and ridges provide sufficient grip to allow the user to control the direction of the sport board, while standing on the board. In this approach, the sport board can act both as a traditional toboggan, but also act as a snowboard.

In this embodiment, the bottom of the sport board can be arcuate, but more preferably, the bottom of the sport board is substantially flat and planar.

For either approach, the various areas of grooves and/or ridges can all be provided on a single flexible, planar sheet or film which can be pre-formed, and then, this sheet or film can be laminated to the bottom of a preferably foam-core sport board which has the desired arcuate, cross-sectional bottom profile.

Further, while it is preferred that the series of alternating ridges and/or grooves covers the entire bottom surface of the sport board, flat surfaces can also be included in any selected region, area or portion. However, it is preferred that at least 25%, and more preferably 50%, and even more preferably at least 75%, of the entire running surface of the sport board, contains ridges and/or grooves.

It is also preferred that the bottom surface of the sport board of the present invention be essentially symmetrical on either side of the central longitudinal axis line.

It should be noted that the ridges and/or grooves of the first embodiment of the sport board of the present invention, provide a better degree of controllability for a user to turn the sport board. For a seated rider, this is particularly the case when the bottom of the board has a arcuate cross-sectional profile, and even more so, when the board has grooves and/or ridges which are not parallel to the longitudinal axis of the board at or near the sides of the sport board, as described hereinabove.

In the second embodiment of the present invention, a smaller number of larger grooves provides better controllability of a sport board which is more similar to the controllability of a conventional snowboard, without being excessively sensitive to over-steering caused by excessive grip.

In either embodiment, however, the convertible sport board of the present invention is capable of acting as either a sport board (or toboggan), or as a snowboard, and the user has the option of using the convertible sport board in either fashion. As such, each approach provides the user with a better degree of controllability when the sport board of the present invention is used either by a seated rider, or a standing rider.

The user therefore has the option of using the sport board either as a traditional toboggan, or as a snow board without making any modification to the sport board, and the products of the present invention are not subject to oversteering caused by excessive grip. As such, the sport board is easily convertible from one intended use to another, and functions well in either application.

Preferably, the sport board includes at least one, and preferably, two foot straps on the top surface of the sport board, so that the user has the option of attaching the foot straps to the their feet, and riding the sport board of the present invention, while standing up, in a manner similar to a more traditional snowboard. While adding straps to the sport board, when needed, is an option, when the straps are built in to the sport board, the sport board of the present invention is readily and easily used as either a traditional "toboggan" or a "snowboard" style of device.

When foot straps are provided, the foot straps are preferably located within indented wells which are provided on the top surface of the sport board. As such, the foot straps, when not in use, can be tightened so as to be essentially flush with the top surface of the sport board. As such, they do not interfere with the top surface for a seated user. Alternatively, they can be held on to board by Velcro fasteners, and thus removed, if not needed or desired.

It is preferred that the foot straps be positioned on the top surface of the sport board so that they are centered on the central, longitudinal axis of the sport board, and extend along the central, longitudinal axis line. As a result, the user's feet will be positioned so that they cross the central, longitudinal axis of the sport board.

However, the foot straps can be positioned and set at any selected or desired location, and the straps can be lengthened or shortened as required in order to adjust the spacing between the foot straps. As such, the foot straps can be custom fitted to the user's preferred foot spacing.

Alternatively, additional foot straps can also be provided on the top surface of the convertible sport board, and the user can select which one or two foot straps are most appropriate for their use.

In a still further embodiment, the straps from two or more foot straps can be provided with sufficient strapping material that they can be interconnected and thus provide a carry strap which can be used to carry the convertible sport board, such as, when climbing back up a hill.

Further, an additional strap can also be provided which extends from the front end of the board to which the user can hold as a strap handle, while gliding on the snow's surface. This further strap handle might be used to hold on to regardless of whether the user is seated or standing. The longer strap handle might also be used to tow the board behind the user, when desired.

Alternatively, in a further option, a more rigid handle can be provided that is preferably hingeably attached and which extends from the front of the board. The rigid handle might be removable, but preferably, is the sport board is provided with a storage recess in the top surface of the board, for storage of the rigid handle. The rigid handle can be affixed using a hinge mechanism so that it can be used while standing, or while seated. The handle (or handle strap) could also extend forwardly, so that the user could merely pull the board, in a manner similar to a sled.

The rigid handle is preferably stored in the recessed opening, when not needed or desired, or it might optionally be removed when not in use. The rigid handle might also be telescopic, so that it can be shortened for storage in the sport board.

It should also be noted that generally, prior art use of a sport board as a snowboard is not generally practical unless the series of ridges and grooves is present. Otherwise, the board would slip uncontrollably as the user attempts to stand on it due to the smooth nature of a traditional sport board, bottom surface. Also, it would be difficult to steer with any precision since the board would merely slip out from underneath the rider.

With the prior art systems with grooves and ridges on the bottom of the sport board, it is possible to steer the board, and it is possible to use the sport boards as a snowboard. However, having an excessive number of grooves and ridges leads to over-steering problems caused by excessive grip on the snow. Other devices have larger ridges or "rails" on the bottom of the sport board, are not suitable for use in the production of a sport board having a laminated running surface attached to the bottom of the sport board.

As such, in the present invention, a sport board is provided having improved steerability characteristics, which are provided by either a reduced number of larger ridges, or by providing a board having a generally arcuate cross-sectional bottom profile such that the ridges and grooves at the side of the board are only used when turning. As such, controllability of the steering of the board—for either a seated or standing operator—is improved.

BRIEF DESCRIPTION OF THE DRAWINGS

Embodiments of this invention will now be described by way of example only in association with the accompanying drawings in which:

FIG. 5 is a cross-sectional view of a second embodiment of the sport board of the present invention;

FIG. 6 is an enlarged section showing a preferred groove and ridge construction of the board of FIG. 5;

DETAILED DESCRIPTION OF THE PREFERRED EMBODIMENTS

Figure 1:
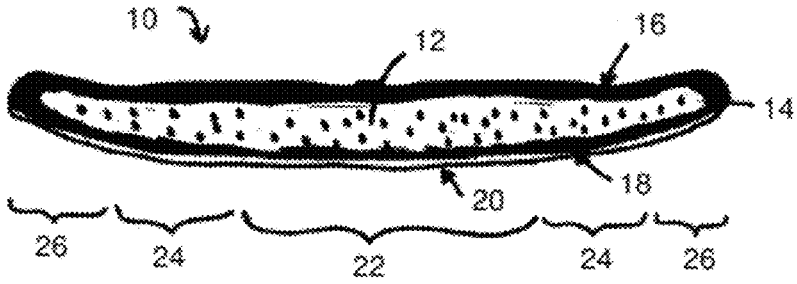
FIG. 1 is a cross-sectional view of one embodiment of the sport board of the present invention.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Figure 2:
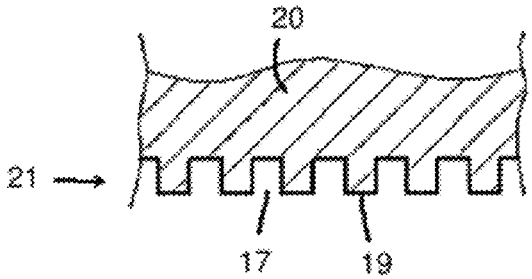
FIG. 2 is an enlarged section showing one preferred groove and ridge construction.

Referring to FIG. 1, a cross-sectional view of a first embodiment of a preferred construction of a sport board 10 of the present invention is shown, and includes an expanded polymer foam core 12, an extruded thermoplastic polymer outer layer 14 having a top surface 16 and a arcuate bottom surface 18, covered with a flexible layer 20 which is laminated to bottom surface 18. The planar layer 20 is preferably a flexible film of material that assumes the shape of bottom surface 18 of sport board 10, and can be essentially permanently affixed to bottom surface 18. The film has sufficient thickness such that the bottom of the laminated planar layer 20 includes a series of longitudinally extending, parallel and alternating grooves and ridges 21, as seen in FIG. 2.

In this embodiment, preferably, the series of grooves and/or ridges on layer 20 have a width and spacing such that there are about ten to about eighty grooves per inch of width. The grooves and/or ridges are preferably spaced however, so that there are provided about forty-five grooves and/or ridges per inch of the width. The grooves and/or ridges may have a depth or height of from about 0.05 mm to about 1 mm, and most preferably, having a depth or height of about 0.4 mm.

The core 12 may be polyurethane foam, polyethylene foam, polypropylene foam or polystyrene foam, and the outer layer 14 is preferably, polyethylene or polypropylene. The substantially planar laminated layer 20 may be polyethylene foam or polypropylene foam, or a polyethylene or polypropylene film, and preferably has a thickness of between 1 and 10 mm, and more preferably, between 2 and 6 mm.

The width of the distances between and within grooves and ridges 21 on the planar layer 20, is preferably uniform, meaning that at least 95% of the grooves are individually of an equal distance from their adjacent grooves, and that the grooves have a uniform width. The grooves and/or ridges can be provided in any desired shape or profile, such as, for example, a triangular, or rounded profile, when viewed in cross section. However, a most preferred groove and/or ridge profile is that of a square-shaped profile, as seen in FIG. 2, and thus creating a combination of grooves 17, and ridges 19.

As seen in FIG. 1, bottom surface 18 of board 10 is essentially arcuate, which in this embodiment means that the bottom surface is curved across the board, such that central area 22 of bottom surface 18 rests on the surface of the snow in normal use, and two side portions 24 and 26, on each side of board 10, are raised off of the snow's surface until the user leans one way or another, and thereby pushes down on one side or the other so as to bring at least one of the selected side portions 24, 26 in contact with the snow. As a result, the opposite side portions on the other side of the board 10, are thereby raised further off of the snow.

At rest, the sides of the sport board 10, are raised 25 to 75 mm above the ground, when the centre of board 10, rests on the ground.

Figure 3:
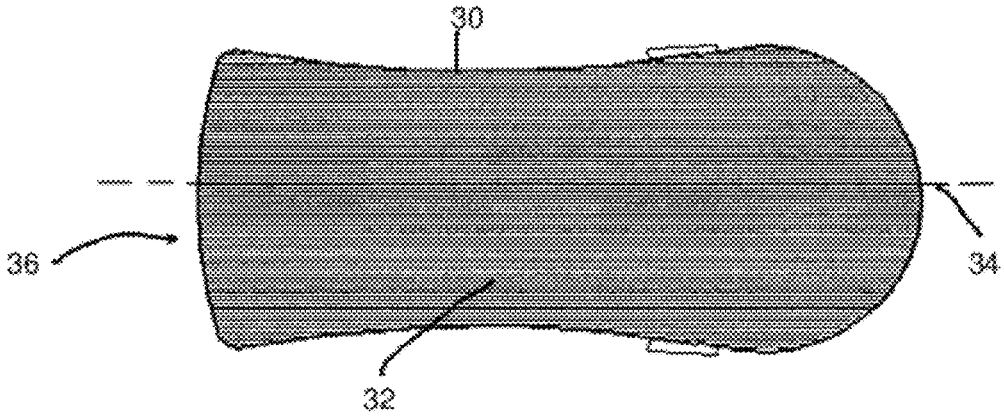
Figure 3 (Prior Art)
FIG. 3 is a view of the bottom of a sport board, according to the prior art.

In FIG. 3, a view of the bottom surface 30 of a prior art board 36 is shown, wherein the series of grooves and ridges 32 are all aligned in one direction; namely along the central longitudinal axis 34 of the board 36. Additionally, it should be noted that board 36 has a bottom surface 30, which is essentially flat.

When used, prior art board 36 tends to travel in a straight line in the longitudinal direction of the grooves and ridges. Steering of the board is not easily performed, since the board must be tilted or bent, in order to modify the angle of the ridges and grooves, with respect to the direction of the sport board travel. As such, oversteering is common as the larger number of side ridges and grooves quickly "dig" into the snow. This is particularly relevant when the prior art sport board is used as a snowboard, by a standing user.

Figure 4:
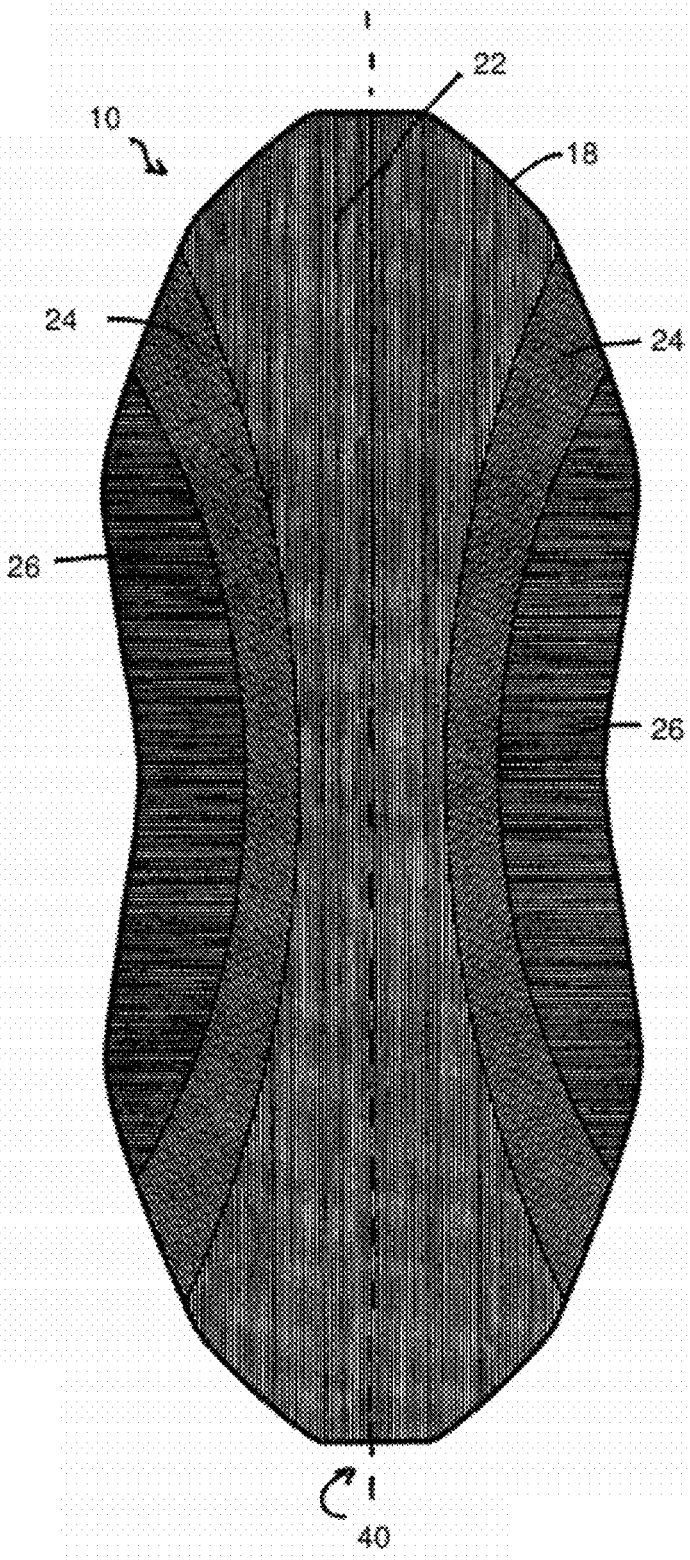
FIG. 4 is a view of the bottom of one embodiment of a sport board, according to the present invention.

In FIG. 4, the complete bottom surface 18 of the board shown in FIG. 1 is presented, wherein the grooves 17 and ridges 19 in a central area 22 of board 10 are also aligned with the longitudinal axis 40 of board 10. In side portion 24, however, the ridges and grooves are cut at 45 degrees to the longitudinal axis line 40, and side portion 24 is generally curved along the side 46 of board 10. In side portion 26, the ridges and grooves are cut at 90 degrees to the longitudinal axis line 40, and side portion 26 is also generally curved along the side 46 of board 10.

In the preferred embodiment, at least the bottom surface 18 of board 10 is shaped so that the amount of arcing in the profile of bottom surface 18, is greatest in the centre of the board, and lessens when the board profile is viewed closed to the front or back of the board.

The front and/or back areas of the board, may also be upturned, and preferably, the left and right side edges of board 10 are also curved so as to provide an inwardly extending curvature that provides a slightly hour-glass shape to the board.

Preferably, side portion 24 separates central area 22 from side portion 26, as shown in the present embodiment. However, this is not essential, and other designs and configurations might be used. Further, the number of portions and the sizing of the portions thereof, can also be changed. The height and depth of the grooves can vary between portions, as can the spacing between the ridges and grooves.

Preferably though, the bottom surface 18 of board 10 is symmetrical along longitudinal axis 40, and there is at least one portion on each side of axis 40, in which the grooves and ridges are not aligned with axis 40, together with a central area between the at least one portions, in which central area, the grooves and ridges are aligned with the longitudinal axis of board 10.

Referring to FIG. 5, a cross-sectional view of a second embodiment of a preferred construction of a sport board 50 of the present invention is shown, and includes an expanded polymer foam core 52, an extruded thermoplastic polymer outer layer 54 having a top surface 56 and a substantially planar bottom surface 58 covered with a flexible layer 60 which is laminated to bottom surface 58. The planar layer 60 is again preferably a flexible film of material that assumes the shape of bottom surface 58 of sport board 50, and can be essentially permanently affixed to bottom surface 58. The film has sufficient thickness such that the bottom of the laminated planar layer 60 includes a series of longitudinally extending, parallel ridges 61, on a flat section 60A, as seen in FIG. 6A.

For this embodiment, preferably, the series of ridges 61 on layer 60 have a width such that there are about 3 to about 7 ridges per inch of width. In the embodiment shown, the ridges are spaced so that there are provided six ridges per inch of the width. The ridges in this embodiment, have a height of 2 mm.

Again, the width and spacing of the ridges 61 on the planar layer 60, is preferably uniform, meaning that at least 95% of the ridges 61 are individually of an equal distance from their adjacent ridges. The ridges can be provided in any desired shape or profile, such as, for example, a triangular, or rounded profile, when viewed in cross section. However, a most preferred ridge profile is that of a square-shaped profile, as seen in FIG. 6, having ridges 61 positioned on a flat section 60A of layer 60.

In FIG. 6B, an optional groove and ridge design is shown wherein both ridges 63 and grooves 65 are fashioned onto a flat surface area 60B of layer 60. The spacing of the grooves 65 and ridges 63 is preferably uniform across the laminate layer, and again, there are preferably about 3 to about 7 ridges per inch of width.

The core 52 is again, a polyurethane foam, polyethylene foam, polypropylene foam or polystyrene foam, and the outer layer 54 is preferably, polyethylene or polypropylene. The substantially planar laminated layer 60 or 60B may be polyethylene foam or polypropylene foam, or a polyethylene or polypropylene film, and preferably has a thickness of between 2 and 10 mm, and more preferably, between 3 and 7 mm.

As seen in FIG. 5, bottom surface 58 of board 50 is substantially planar, which in this embodiment means that the bottom surface 58 is essentially flat across the board, such that much of bottom surface 58 rests on the surface of the snow in normal use, and the edges 64 and 66 of board 50 are typically no more than 25 mm from the ground, when board 50 is at rest.

Figure 7:
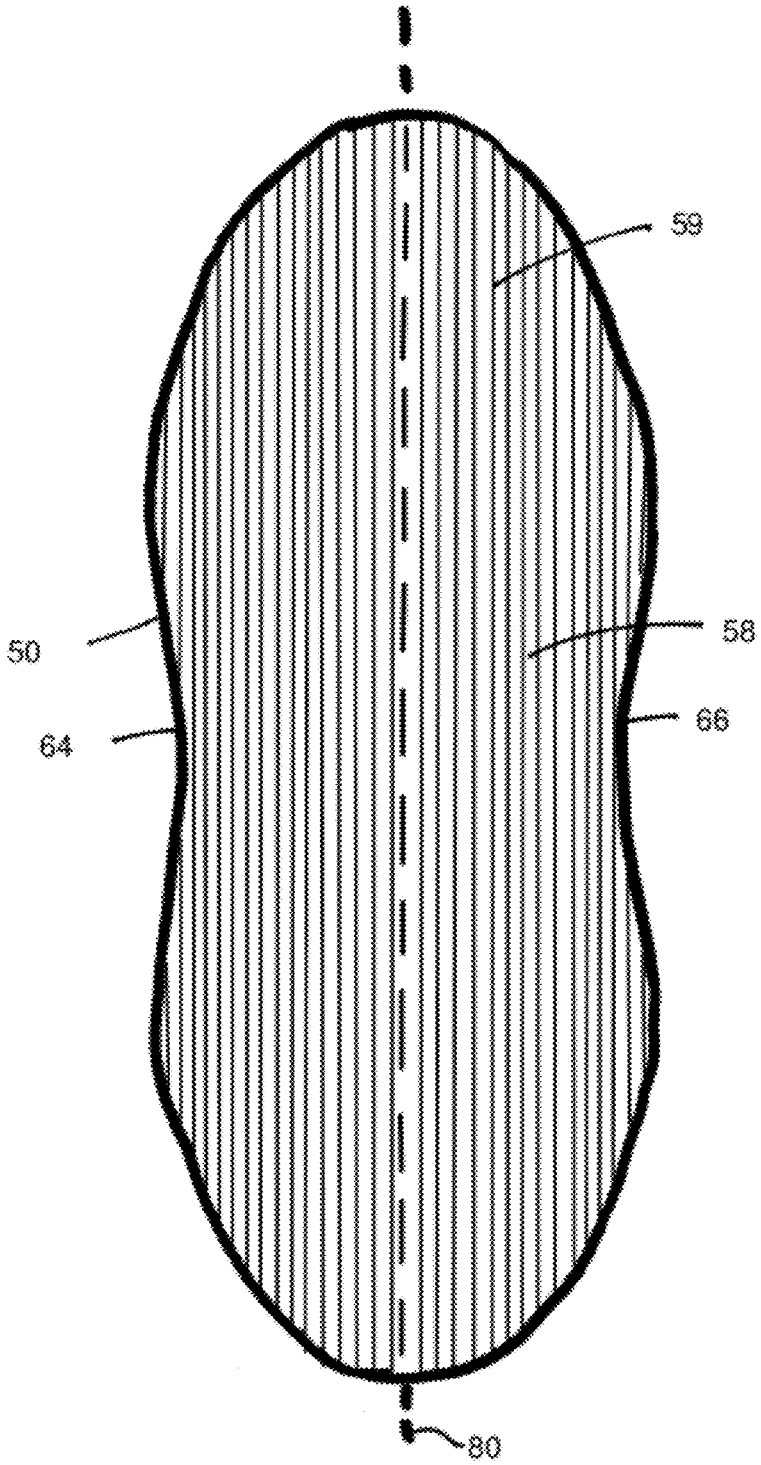
FIG. 7 is a bottom view of the sport board of FIG. 5.

In FIG. 7, the complete bottom surface 58 of the board shown in FIG. 5 is presented, wherein the ridges 59 are all aligned with the longitudinal axis 80 of board 50.

Again, the front and/or back areas of the board, may be upturned, and preferably, the left and right side edges of board 50 include an inwardly extending curvature that provides a slightly hour-glass shape to the board. Preferably, the bottom surface 58 of board 50 is symmetrical along longitudinal axis 80.

This bottom profile provides a sport board having good sliding characteristics in a straight line, while allowed improved steering and directional control, by a user;—either in a standing or sitting position.

Figures 8, 9:
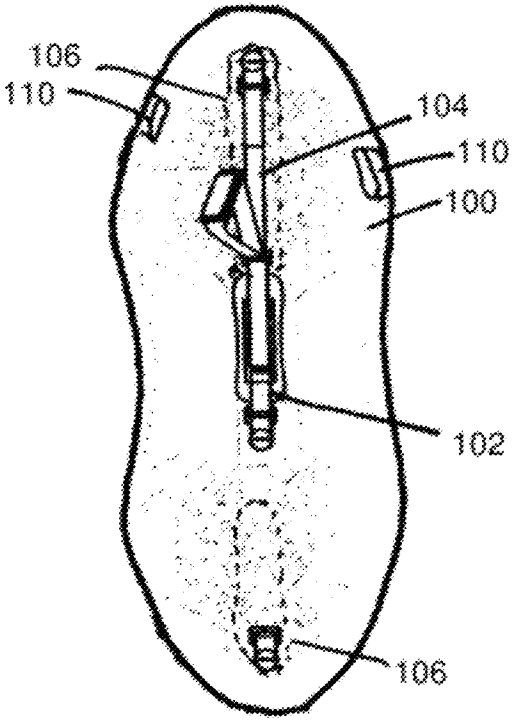
FIG. 8 is a top view of a second aspect of the invention showing a sport board which includes a foot strap and a hand strap.
FIG. 9 is a top view of the embodiment of FIG. 8, wherein the foot strap and hand strap are combined to form a carrying handle.

In FIG. 8, a top view of the top surface of a board 100 is shown having a foot strap 102 in which the user can place their feet, and a hand strap 104 which the user can use while standing or sitting on board 100. Additional foot straps can be provided in place of, or in combination with, hand strap 104 so that the user can separately strap each foot into the sport board 100, in the manner of a snow board.

It should be noted that this top surface design can be utilized with either of the sport boards designs shown in FIG. 4, or in FIG. 7.

The hand strap 104 and the foot strap 102 are preferably manufactured from a flexible material, such as, flexible nylon strapping. Adjustable nylon or plastic clips 108 can be provide for adjustment of the length of straps 104 and 102.

Hand strap 104 and foot strap 102 are preferably of a similar size and are preferably arranged so that they can be interconnected in order to form a longer, combined strap, as seen in FIG. 9, which can be used for carrying board 100, when not in use.

Recesses 106 can be provided in board 100 so that straps 102 and 104 can lie essentially flush with the rest of the top surface of board 100, so that they will not interfere with a rider sitting on board 100, who does not wish to use either set of straps 102 or 104.

Additionally, handles 110 are can be provided on the sides of board 100 so as to allow the user to hold onto, while seated.

Hand strap 104 can also be replaced with a more rigid handle such as a plastic handle (not shown) which can be hingeably connected at or near the front of board 100. Again, a recess in the top surface of board 100, can be provided so as to hold the rigid handle, when not used.

Figure 10:
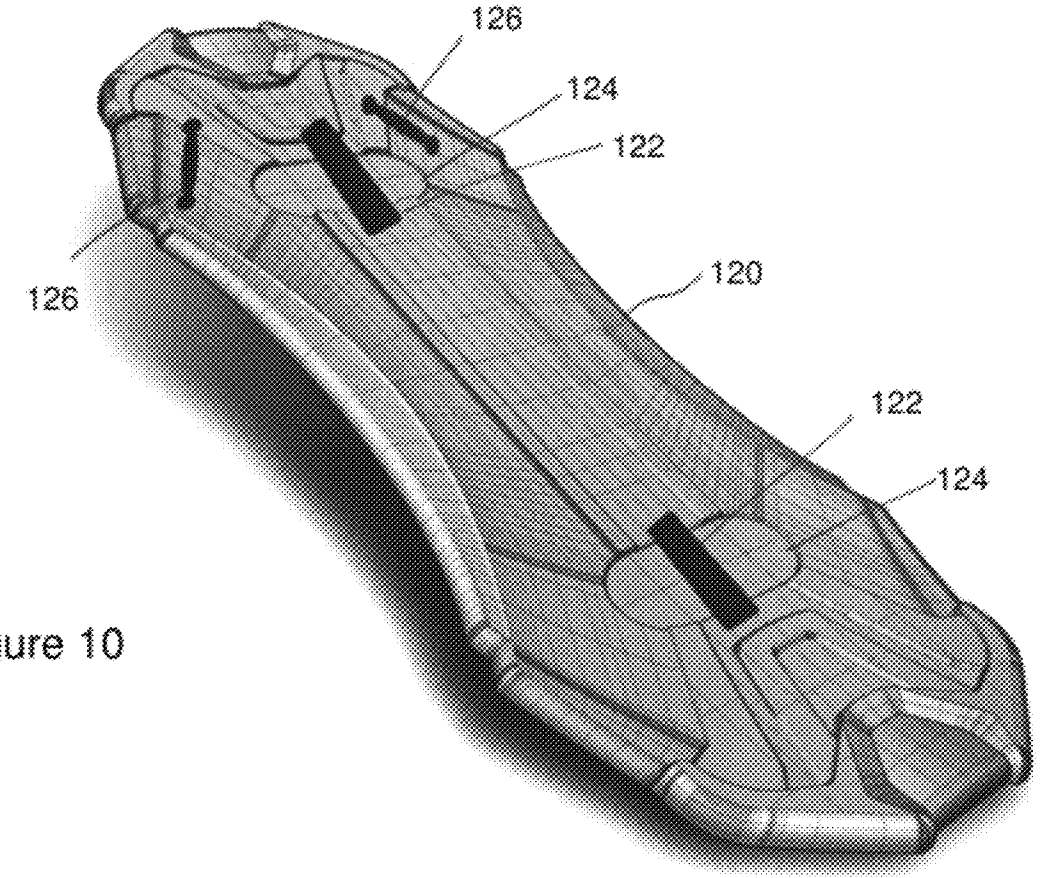
FIG. 10 is a perspective view of the top of an alternative sport board design having two foot straps and side handles.

In FIG. 10, a second embodiment of the top section of a sport board 120, similar to FIG. 8 of the present invention is shown, in which two foot strap 122 are provided, each of which is located within a recess 124. The foots straps 122 are used by a standing rider. Handles 126 are provided at the sides of sport board 120, and are for use by a seated rider, or by a prone rider.

Thus, it is apparent that there has been provided, in accordance with the present invention, a sport board and/or a convertible sport board, which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Also, unless otherwise specifically noted, all of the features described herein may be combined with any of the above aspects, in any combination.

Further, use of the terms "he", "him", or "his", is not intended to be specifically directed to persons of the masculine gender, and could easily be read as "she", "her", or "hers", respectively. Similarly, use of terms such as top, bottom sides, front, back, and the like, are used to describe the relative positioning of various components, when the sport board is used in its normal configuration.

Finally, while this discussion has addressed prior art known to the inventor, it is not an admission that all art discussed is citable against the present application.

What is claimed is:

1. A convertible sport board having a polymer shell, wherein a running surface is laminated to the bottom of the polymer shell of said board, and wherein said laminated running surface comprises a series of longitudinally extending grooves and/or ridges on the running surface to provide improved gliding and turning properties, and thus allows the sport board to also be used as a snowboard, and wherein the sport board includes a bottom profile configured to a substantially hour glass shape defined as having top edge and a distal bottom edge and a center region positioned between the top edge and the bottom edge, the top edge tapering outwardly along side edges to a first convex bulbous region, the first convex bulbous region then tapering inwardly along a concave center region, the concave center region then tapering outwardly along the side edges to a second convex bulbous region, the second convex bulbous region then tapering inwardly along the side edges to the bottom edge, and wherein the first convex bulbous region is positioned substantially between the top edge and center region, and wherein the second convex bulbous region is positioned substantially between the bottom edge and center region.

2. A convertible sport board as claimed in claim 1 wherein said sport board comprises a foam core, and a harder polymer outer shell, and wherein a running surface is laminated to the bottom of the outer shell, wherein said laminated running surface comprises a series of longitudinally extending, parallel and alternating grooves and/or ridges provided across the running surface, and wherein said sport board has a generally arcuate cross-section profile across the bottom of the board, so as to provide a central portion of said board normally in contact with the snow, and side portions normally not in contact with the snow.

3. A convertible sport board as claimed in claim 2 wherein said grooves and/or ridges on said running surface have a width and spacing such that there are about ten to about eighty grooves per inch of width, and wherein the grooves and/or ridges have depth or height of from about 0.05 mm to about 1 mm.

4. A convertible sport board as claimed in claim 2 wherein the grooves and/or ridges in a central portion of the sport board are aligned with the longitudinal axis of the sport board, and wherein said grooves and ridges on said side portions are primarily not parallel to the longitudinal axis of the sport board.

5. A convertible sport board as claimed in claim 4 wherein the grooves and/or ridges on these side portions have sections wherein at least a portion of the grooves and/or ridges present, are between 10 and 90 degrees off parallel to the longitudinal axis.

6. A convertible sport board as claimed in claim 1 wherein said sport board has a generally planar cross-section profile across the bottom of the board, and wherein said running surface comprises a series of longitudinally extending, parallel and alternating grooves and/or ridges provided across the running surface, at a spacing of between 0.5 and 9 grooves and/or ridges per inch.

7. A convertible sport board as claimed in claim 6 wherein the spacing of said grooves and/or ridges is between 3 and 7 grooves and/or ridges per inch.

8. A convertible sport board as claimed in claim 6 wherein a series of parallel ridges is provided, and wherein the ridges are from 1 mm to 10 mm in height.

9. A convertible sport board as claimed in claim 6 wherein a series of parallel ridges is provided, and wherein the ridges are from 2 mm to 5 mm in height.

10. A convertible sport board as claimed in claim 6, additionally comprising grooves between the ridges, and wherein said grooves have a depth of between 0.1 to 2 mm.

11. A convertible sport board as claimed in claim 1 wherein at least 50% of the entire running surface of the sport board comprises ridges and/or grooves.

12. A convertible sport board as claimed in claim 1 additionally comprising at least one foot strap on the top surface of said sport board.

13. A convertible sport board as claimed in claim 12 wherein said foot straps are located within indented wells located on the top surface of the sport board.

14. A convertible sport board as claimed in claim 12 wherein said foot straps are position on the top surface of the sport board so that they are centered on the central, longitudinal axis of the sport board, and extend along the central, longitudinal axis line.

* * * * *